US007475674B2

(12) United States Patent
Marksteiner et al.

(10) Patent No.: US 7,475,674 B2
(45) Date of Patent: Jan. 13, 2009

(54) LEAKAGE CONNECTION FOR A FUEL INJECTOR

(75) Inventors: Dieter Marksteiner, Regensburg (DE); Klaus Rübling, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 18 days.

(21) Appl. No.: 11/771,077

(22) Filed: Jun. 29, 2007

(65) Prior Publication Data

US 2007/0283932 A1 Dec. 13, 2007

Related U.S. Application Data

(60) Division of application No. 10/962,820, filed on Oct. 8, 2004, now abandoned, which is a continuation of application No. PCT/DE03/01239, filed on Apr. 11, 2003.

(30) Foreign Application Priority Data

Apr. 11, 2002 (DE) ..... 102 15 980

(51) Int. Cl.
*F02M 55/02* (2006.01)
*F02M 61/14* (2006.01)

(52) U.S. Cl. ..... 123/468; 123/469; 123/470

(58) Field of Classification Search ..... 123/468, 123/469, 470, 514
See application file for complete search history.

(56) References Cited

U.S. PATENT DOCUMENTS

| | | | | | |
|---|---|---|---|---|---|
| 2,389,492 | A | | 11/1945 | Edwards | 123/503 |
| 3,608,171 | A | * | 9/1971 | Stradtmann | 29/890.129 |
| 3,817,456 | A | | 6/1974 | Schlappkohl | 239/533 |
| 3,934,903 | A | | 1/1976 | Hofmann et al. | 285/156 |
| 4,202,500 | A | | 5/1980 | Keiczek | 239/533.3 |
| 4,205,789 | A | * | 6/1980 | Raufeisen | 239/533.3 |
| 4,228,960 | A | | 10/1980 | Mowbray et al. | 239/533.9 |
| 4,341,351 | A | | 7/1982 | DeLuca | 239/453 |
| 4,344,575 | A | | 8/1982 | Seifert | 239/533.5 |
| 4,715,103 | A | * | 12/1987 | Jaksa et al. | 29/888.02 |
| 4,790,055 | A | | 12/1988 | Raufeisen et al. | 29/156.7 R |
| 5,033,716 | A | | 7/1991 | Mesenich | 251/129.21 |
| 5,205,492 | A | | 4/1993 | Khinchuk | 239/533.4 |
| 5,209,408 | A | | 5/1993 | Reiter | 239/585.4 |
| 5,697,154 | A | | 12/1997 | Ogihara | 29/890.142 |
| 5,746,181 | A | | 5/1998 | Boecking et al. | 123/470 |
| 5,826,793 | A | | 10/1998 | Askew | 239/124 |
| 5,897,058 | A | | 4/1999 | Coldren et al. | 239/88 |

(Continued)

FOREIGN PATENT DOCUMENTS

| | | | |
|---|---|---|---|
| DE | 567230 | 1/1933 | 46/103 |

(Continued)

OTHER PUBLICATIONS

PCT International Search Report for PCT/DE03/01239, 3 pages.

*Primary Examiner*—Thomas N Moulis
(74) *Attorney, Agent, or Firm*—Baker Botts L.L.P.

(57) ABSTRACT

The invention relates to a leakage connection for an injector, which inject fuel into a combustion chamber of an internal combustion engine. The leakage connection is configured as one piece with an injector component. In addition, a leakage nipple is integrated into the leakage connection, for attaching a leakage return line.

19 Claims, 5 Drawing Sheets

U.S. PATENT DOCUMENTS

| | | | | |
|---|---|---|---|---|
| 5,979,411 | A * | 11/1999 | Ricco | 123/469 |
| 6,142,122 | A | 11/2000 | Hoppenstedt | 123/469 |
| 6,182,912 | B1 | 2/2001 | Müller et al. | 239/585.1 |
| 6,609,667 | B2 | 8/2003 | Kiriki et al. | 239/533.3 |
| 6,779,748 | B2 | 10/2004 | Enke et al. | 251/362 |
| 6,892,706 | B2 * | 5/2005 | Kienzler et al. | 123/468 |
| 6,928,984 | B1 | 8/2005 | Shamine et al. | 123/456 |
| 7,226,088 | B2 * | 6/2007 | Skiba et al. | 285/92 |
| 7,331,330 | B2 * | 2/2008 | Houy et al. | 123/470 |
| 2002/0008159 | A1 | 1/2002 | Katsura et al. | 239/102.2 |

FOREIGN PATENT DOCUMENTS

| | | | |
|---|---|---|---|
| DE | 19900508 | A1 | 7/2000 |
| DE | 19915685 | A1 | 10/2000 |
| DE | 19940387 | C1 | 2/2001 |
| DE | 10017113 | A1 | 10/2001 |
| DE | 10036137 | A1 | 2/2002 |
| EP | 079991 | A1 | 3/1997 |
| EP | 0957262 | A2 | 5/1999 |
| EP | 0637686 | B1 | 7/2004 |
| EP | 1 043 496 | B1 | 9/2004 |
| GB | 423126 | | 1/1935 |
| JP | 04058061 | A | 2/1992 |
| WO | 99/10648 | | 3/1999 |
| WO | 00/60233 | | 10/2000 |
| WO | 02/063159 | | 8/2002 |
| WO | 03/062630 | | 7/2003 |
| WO | 03/087567 | | 10/2003 |

* cited by examiner

LEAKAGE CONNECTION FOR A FUEL INJECTOR

CROSS-REFERENCE TO RELATED APPLICATION OR PRIORITY

This application is a divisional of U.S. patent application Ser. No. 10/962,820 filed Oct. 8, 2004, abandoned; which is a continuation of International Application No. PCT/DE03/01239 filed Apr. 11, 2003, which designates the United States, and claims priority to German application number DE10215980.7 filed Apr. 11, 2002, the contents of which are incorporated by reference in their entirety.

FIELD OF THE INVENTION

The invention relates to a leakage connection for an injector, which injects fuel into a combustion chamber of an internal combustion engine.

BACKGROUND OF THE INVENTION

Accumulator injection systems which operate with very high injection pressures are increasingly being used as fuel supply systems for internal combustion engines. In these accumulator injection systems, fuel is delivered by means of a high-pressure pump into a fuel injector, from which the fuel is injected into the combustion chamber of the internal combustion engine. A fuel injector of this type has an injection valve which is hydraulically opened or closed by a control valve with the help of applied fuel pressure. This control valve is actuated by an actuator.

Because of the high pressure, there is a greater backflow of fuel from the fuel injector particularly during the control process by the control valve. This backflow is carried back into a fuel reservoir via a leakage line. As known, for example from DE 199 40 387 C1, the leakage connection is formed on the injector by a stepped bore into which a line with a connection nipple is inserted. To prevent the connection nipple from being pushed out by fuel draining away out of the leakage connection, the connection nipple is secured to the fuel injector by means of an axial securing device. This arrangement, however, is relatively expensive and incorporates a great many individual components.

An alternative option for fixing a leakage line with nipple to a leakage connection of the injector by means of a spring element is known, for example, from EP 0 886 065 A1. This solution, however, likewise has a great many components and entails relatively high production and installation costs.

SUMMARY OF THE INVENTION

The object of this invention, therefore, is to provide a leakage connection for an injector, which is simple to install and can be produced easily and cost-effectively, and which facilitates a secure seal between the leakage connection and a leakage return line.

This object is achieved by a leakage connection with the following features: an injector component incorporating an integrated leakage nipple for the attachment of a leakage return line, wherein said connection is a single unitary piece.

The object of the invention is also achieved by a leakage connection having the following features: an incorporated integrated leakage nipple for attachment to a leakage return line and an integrated retaining device to enable the leakage connection to be fastened to another injector component.

According to a first aspect of the invention, the attachment of the leakage return line to a leakage connection on the fuel injector is achieved in that the leakage connection is configured as one piece with an existing component of the injector, and a leakage nipple for attaching a leakage return line is configured in one piece at the leakage connection. According to the invention, therefore, the leakage connection with the function of attaching a leakage return line is also integrated in an existing component of the injector with a corresponding component function. In this way, the number of components can be kept low. The costly securing of a leakage nipple to the leakage return line in the leakage connection, which is necessary in the prior art, is no longer required. It is thus also possible to dispense with the costly stepped bore in the leakage connection that is necessary in the prior art. According to the invention, therefore, significant reductions in manufacturing costs can be achieved, which in turn brings great cost advantages—particularly for large quantities of fuel injectors.

Preferably, the leakage connection according to the invention is constructed such that two leakage nipples are integrated in the component of the injector with leakage connection. Thus the injector component has two leakage connections, so that a leakage can be diverted at different places in the injector. The two leakage nipples are preferably arranged opposite one another at 180°.

To ensure ease of installation and to make the draining of the leakage flow away as smoothly as possible, the connection nipples are preferably arranged at an angle of approximately 45° to the principle axis of the injector.

To ensure ease of connection between the injector component with leakage connection and the injector, a recess should be formed at a connecting point between an internal injector leakage line and the leakage connection. In particular, the recess should preferably be formed as a circumferential groove, which is covered over by the injector component with integrated leakage connection. It should be noted that the circumferential groove may, of course, also be constructed in the injector component with leakage connection, or that a recess is provided both on the injector component with leakage connection and on the adjacent injector component, said recess then providing a circumferential channel in the installed state.

To achieve a secure seal of the connecting point between the injector component with leakage connection and the injector, the connecting point should preferably be sealed by means of at least one sealing ring. This sealing ring may be arranged either in the injector component with leakage connection or in the other injector component.

In order to accommodate the greatest possible quantity of leakage in the fuel injector, said injector preferably has an essentially vertically running leakage collection bore, which is connected to the leakage connection via a cross bore.

According to a particularly preferred exemplary embodiment of the invention, the injector component with integrated leakage connection is a coupling element between injector and an engine component, e.g. the cylinder head. This coupling element is preferably a centralizer sleeve or an attenuation component. Thus the centralizer sleeve is used firstly for centering the injector in a cylinder head of the internal combustion engine, and has the additional function of attaching the leakage return line. The attenuation component also has the function of attaching the leakage return line in addition to its attenuation function.

The internal wall of the coupling element is advantageously used as the sealing seat for a ring-shaped sealing. In this way, a secure sealing of the connecting point between the coupling element and the injector can be achieved.

Leakage connections of different injectors are advantageously connected to one another such that a leakage return line that is connected or arranged in series is constructed. For this purpose at least one injector component with leakage connection must have a plurality of leakage connections and one of these leakage connections must then be connected to the leakage return line in the fuel reservoir. It is particularly advantageous if these injector components are each constructed with two leakage connections, so that a series connection with short paths can easily be implemented.

To enable the injector component with integrated leakage connection to be produced as cost-effectively as possible, the component is preferably manufactured from plastic. This enables the injector component with integrated leakage connection to be manufactured easily, e.g. by means of injection molding. It should be noted, however, that the component with leakage connection might also be manufactured from metal.

To enable the leakage return line to be fastened quickly and easily to the leakage nipple, said leakage nipple preferably has an undercut. This enables the leakage return line to be adequately secured to the leakage nipple and ensures quick and easy installation and deinstallation of the leakage return line.

This invention also relates to a leakage return device with a leakage connection according to the invention.

According to a second aspect of this invention, a leakage connection for an injector which injects fuel incorporates an integrated leakage nipple for attaching a leakage return line and an integrated retaining device. The retaining device enables the leakage connection to be fixed to another injector component that is already present. In this way, the attachment of the leakage connection to an existing component of the injector is integrated according to the invention.

The integrally constructed retaining device of the leakage connection advantageously has two clamping arms which enable a non-positive and positive connection with the existing injector component to be effected.

To make installation particularly straightforward, the clamping arms preferably have a fixing area and an installation assistance area. The fixing area is used for fastening the leakage connection to the existing injector component.

In particular, the clamping arms are preferably arranged laterally on one leakage drain of the leakage connection. In this way, a connection point between the clamping arms and the leakage drain also acts at the same time as a swivel point for the clamping arms. This connection point therefore also serves to divide the clamping arm into the fixing area and the installation assistance area.

It is particularly advantageous for the leakage connection to be constructed in a T-shape with two integrated leakage nipples. This facilitates redundant draining of the leakage or simplifies the connection in series of several leakage connections of different injectors.

The injector component to which the leakage connection can be fixed is ideally a fuel supply branch. This enables the leakage connection according to the invention to be constructed in a particularly compact way. It is particularly preferable for the fixing area of the clamping arm to be constructed in a flattened form, perpendicular to the axial direction of the fuel supply branch, so that the clamping arm can be fastened to the flattened fixing area, for example by means of a nut.

Thus the leakage connection permits construction with very few components, resulting in a significant reduction in the cost of installation. Furthermore, no complicated fixing devices are necessary for attaching the leakage connection. Moreover, by attaching the leakage connection to a fuel supply branch, a particularly compact design can be achieved with significant advantages in terms of installation space.

The invention is described below on the basis of preferred exemplary embodiments together with the drawings.

DETAILED DESCRIPTION OF THE PREFERRED EMBODIMENTS

Figure 1:
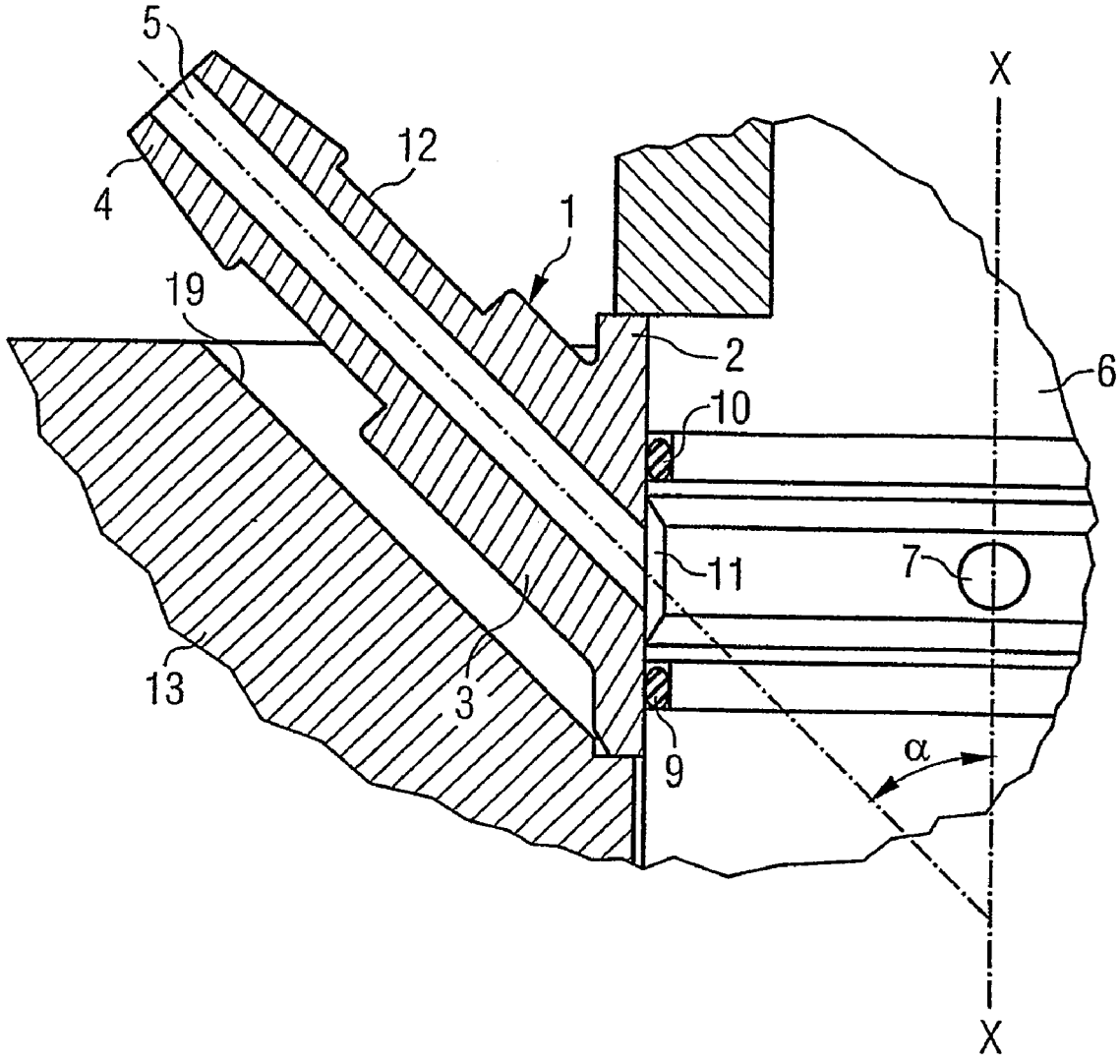
FIG. 1 shows a schematic sectional view of an injector component with integrated leakage connection according to a first exemplary embodiment of the invention.

A first exemplary embodiment of the invention is described below with reference to FIGS. 1 to 3. As shown in FIG. 1, the injector component 1 with integrated leakage connection incorporates a centralizer sleeve 2 as well as an integrated leakage connection 3. The centralizer sleeve 2 is used for centering the fuel injector 6 in a bore in a cylinder head 13 of an internal combustion engine.

As shown in FIG. 1, the leakage connection 3 incorporates an integrated nipple 4. The leakage connection 3 is constructed at an angle $\alpha$ of approximately 45° to a principle axis of the injector X-X. A corresponding recess 19 for accommodating the leakage connection 3 is constructed in the cylinder head 13. The leakage connection 3 incorporates the integrated nipple 4 and an internal leakage bore 5. Moreover, an undercut 12 is provided to enable a leakage return line (not illustrated) to be securely fastened.

Figure 2:
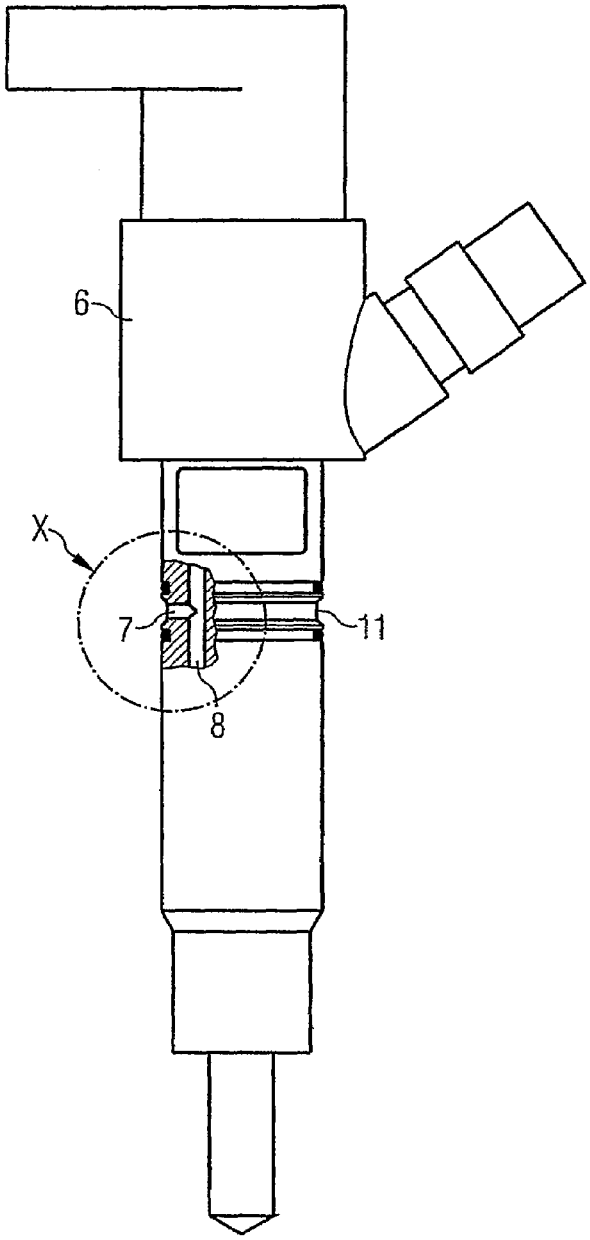
FIG. 2 shows a schematic lateral view of an injector for a leakage connection shown in FIG. 1.
Figure 3:
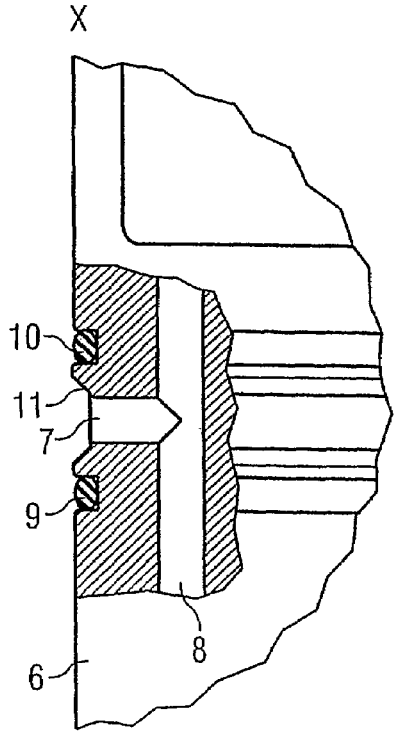
FIG. 3 shows a detailed view of Detail X of FIG. 2.

As shown in FIGS. 2 and 3 in particular, the injector 6 incorporates a vertically running leakage collection bore 8, in which the fuel backflow quantity of the injector, as well as leakages caused by cracks between the injector components, run together. A horizontal cross bore 7 runs from the leakage collection bore 8 to the exterior of the injector 6. As shown in FIG. 1, a circumferential groove 11 is constructed in the injector 6 in the area of the cross bore 7. The injector component 1 is arranged on this circumferential groove, in order to carry the leakage flow into the leakage return line. To obtain a seal between the injector component 1 and the injector 6, a sealing ring 9, 10 is arranged above and below the circumferential groove. The leakage collected in the vertical leakage collection bore 8 is thus carried via the horizontal cross bore 7 and the circumferential groove 11 to the leakage connection 3, and from there into the leakage return line.

Thus the injector component 1 incorporates both the centralizer sleeve 2 and the leakage connection 3—with integrated nipple 4—which is configured in one piece with it. According to the invention, therefore, the number of components can be kept low, whilst a secure connection can be obtained by providing the nipple 4 for fastening a leakage return line. By providing the undercut 12, a leakage return line fitted over the nipple 4 is securely fastened to the leakage connection 3. Thus rapid installation and deinstallation can be achieved. If a particularly secure connection between the leakage return line and the leakage connection 3 is required, a clamp component—such as, for example, a clip—can be fastened to the leakage return line from the outside in the area of the undercut, in order to clamp the leakage return line to the undercut 12.

An injector component 1 with integrated leakage connection 3 according to a second exemplary embodiment of the invention is described below with reference to FIGS. 4 to 6. The same or functionally similar components are identified again using the same reference numbers.

Figure 4:
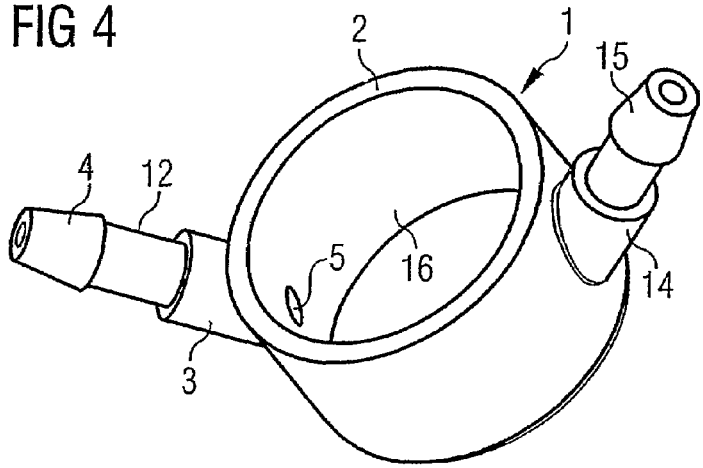
FIG. 4 shows a schematic, perspective view of an injector component with integrated leakage connection according to a second exemplary embodiment of the invention.
Figure 5:
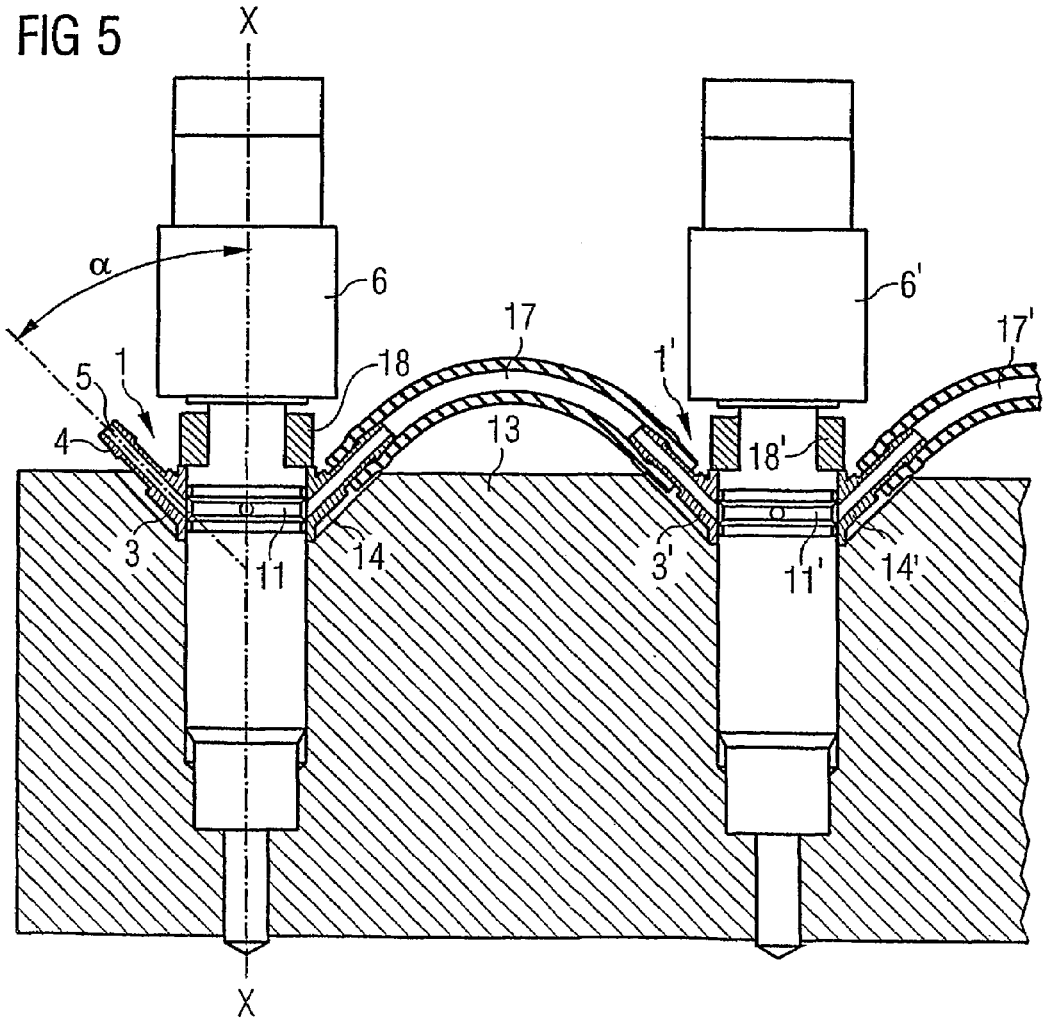
FIG. 5 shows a schematic, partially cut-away view of the installed injector components with integrated leakage connection as per FIG. 4.

As shown in FIGS. 4 and 5 in particular, the injector component 1 likewise incorporates a centralizer sleeve 2 according to the second exemplary embodiment. Unlike in the first exemplary embodiment, however, the second exemplary embodiment incorporates a first leakage connection 3 and a second leakage connection 14 with an integrated nipple 15. Thus, according to the second exemplary embodiment, the injector component 1 incorporates two integrated leakage connections 3 and 14. These two leakage connections 3 and 14 are arranged opposite one another at 180°. An internal wall 16 of the centralizer sleeve 2 is formed as an installation surface for two sealing rings which seal a circumferential groove 11 formed on the injector 6.

Figure 6:
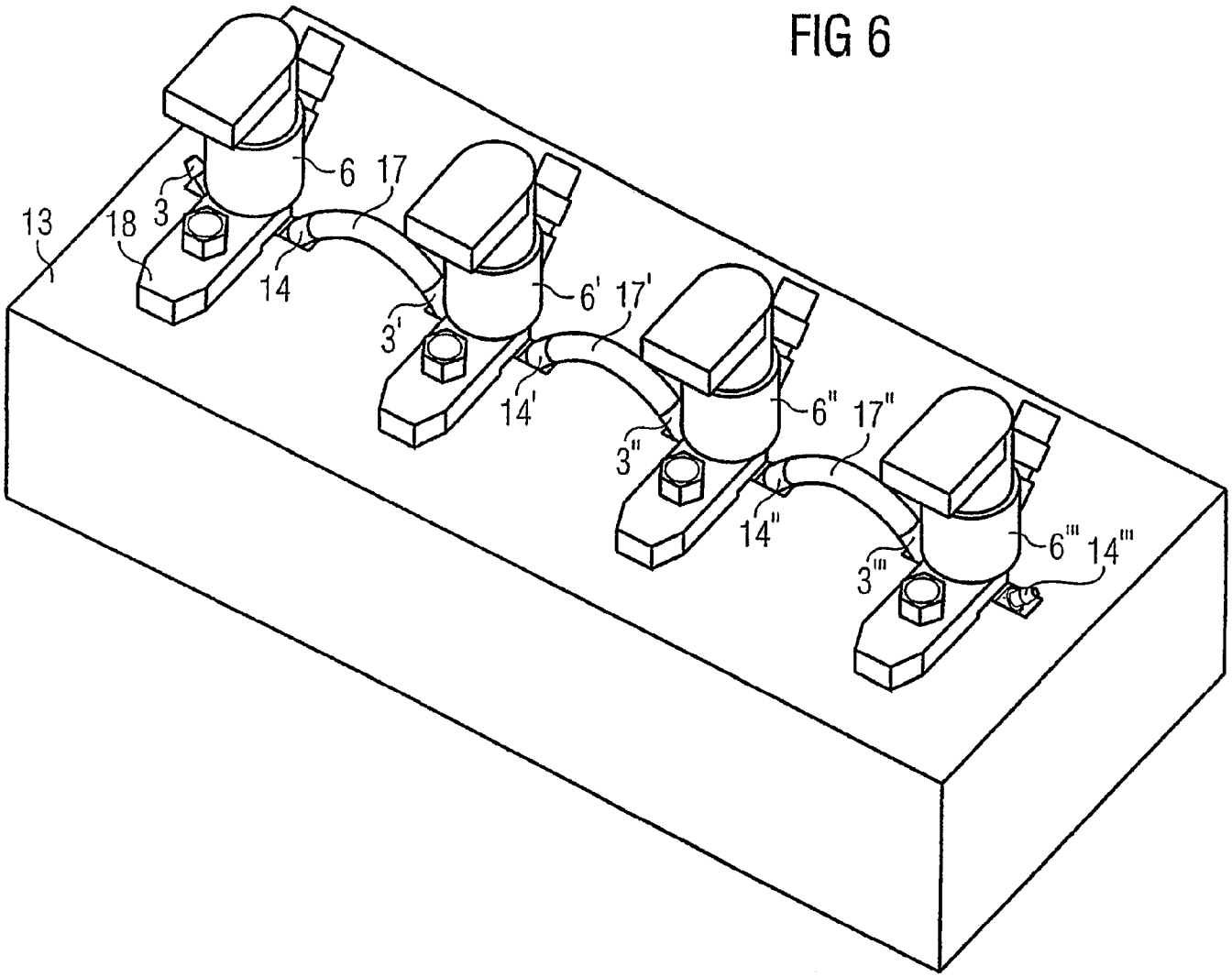
FIG. 6 shows a schematic, perspective partial view of an accumulator injection system with a leakage connection according to the second exemplary embodiment.

As shown in FIGS. 5 and 6, the individual injectors 6 are each fastened to the cylinder head 13 by means of clamping brackets 18. The clamping bracket 18 fixes the injector 6 in the cylinder head 13 with regard to axial movements. The sleeves 2 are arranged such that they are able to equalize installation tolerances with regard to a mounting in the axial direction X-X.

Construction of the injector component 1 with two leakage connections 3 and 14 makes it possible—as shown in particular by FIGS. 5 and 6—to construct a leakage return in a series connection. The leakage occurring in the injector 6 is carried away via the circumferential groove 11 both to the first leakage connection 3 and to the second leakage connection 14. The leakage is carried from the second leakage connection 14 via a leakage return line 17 to a first leakage connection 3' of a second injector 6'. The leakage is carried further from the second injector 6' via a circumferential groove 11' (FIG. 5) to a second leakage connection 14' of the second injector 6' and via the leakage line 17' to a third injector 6". Similarly, the leakage is carried from the third injector 6" via the leakage return line 17" to a fourth injector 6''', and is carried back from the second leakage connection 14''' of the fourth injector 6''' to a fuel reservoir. This construction, i.e. arranging several leakage connections of different injectors in series, enables a particularly compact design to be effected for the leakage return. As shown in FIG. 6, the leakage can be carried away via the first leakage connection 3 of the first injector 6 and the second leakage connection 14''' of the fourth injector 6'''. This enables a redundant leakage return to be constructed. There are very short lines running between the individual injectors.

By combining—according to the invention—a second function into a component, i.e. an attachment function for a leakage line, and a centering function for the injector as in the exemplary embodiments, fewer components are required than in the prior art. This reduces the cost of installation and also enables manufacturing costs to be reduced. Furthermore, particularly by arranging the leakage return lines in series, a particularly compact leakage device can be produced. This results in advantages in terms of installation space compared to the prior art.

Thus this invention relates to a leakage connection 3 for an injector 6, which injects fuel into a combustion chamber of an internal combustion engine. The leakage connection 3 is configured as one piece with an injector component 1. In addition, a leakage nipple 4 is integrated into the leakage connection 3 for attaching a leakage return line 17.

A leakage connection 23 according to a third exemplary embodiment of the invention is described below with reference to FIGS. 7 and 8.

Unlike in the previous exemplary embodiments, the leakage connection according to the third exemplary embodiment incorporates a retaining device consisting of a first clamping arm 28 and a second clamping arm 29 integrated into the leakage connection 23.

Figure 7:
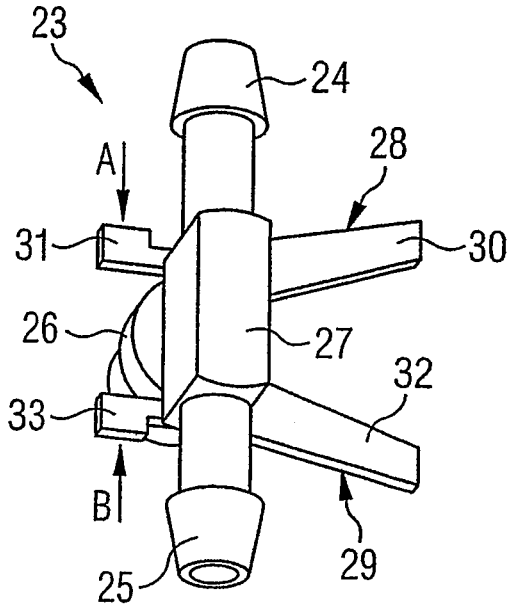
FIG. 7 shows a perspective view of a leakage connection according to a third exemplary embodiment of the invention.

As shown by FIG. 7 in particular, the leakage connection 23 is constructed in a T shape. The leakage connection 23 incorporates leakage drain 26 fastened in the injector and which flows into a branching line 27, said branching line 27 having an integrated connection nipple 24, 25 at both ends. Thus the leakage connection 23 is essentially T-shaped.

As FIG. 7 also shows, the two clamping arms 28, 29 are integrated into the leakage connection 23, on the periphery of the branching line 27 directed toward the injector. The first clamping arm 28 has a fixing area 32 and an installation assistance area 31. The second clamping arm 29 likewise has a fixing area 32 and an installation assistance area 33. The clamping arms 28, 29 are fastened by a swivel connection at the connecting point between the clamping arms 28, 29 and the leakage drain 26. This may be implemented, for example, such that the leakage connection 23 is manufactured entirely from a plastic by means of injection molding. The installation assistance areas 31, 33 are deployed in the installation such that they are moved toward one another when pushed together in the direction shown by the arrows A and B. This causes the fixing areas 30 and 32 of the clamping arms 28 and 29 to spread apart, thus facilitating installation of the leakage connection 23. This spreading apart of the fixing areas 30 and 32 is effected by means of a lever principle, so that only minimal installation force is required.

Because of the elasticity of the clamping arms 28 and 29, these resume their original shape after the installation force on the installation assistance areas 31 and 33 is removed.

Figure 8:
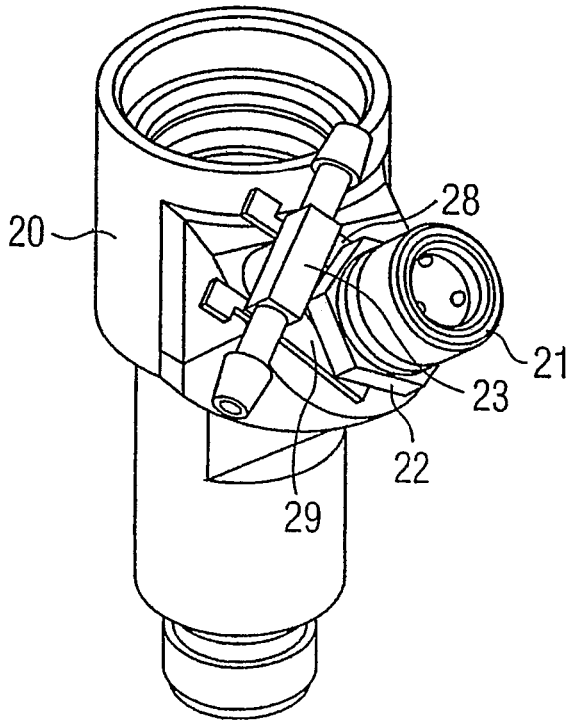
FIG. 8 shows a perspective view of the leakage connection shown in FIG. 7, in the installed state.

FIG. 8 shows the installed state of the leakage connection 23. As shown in FIG. 8, the clamping arms 28, 29 encompass a high-pressure supply branch 21. These clamping arms 28, 29 are fixed to the supply branch 21 by means of a nut 22. To make fastening easier, the clamping arms 28, 29 are constructed with their fixing area 30, 32 flattened, perpendicular to the axial direction of the fuel supply branch 21. This enables the leakage connection to be fastened more securely to the supply branch 21. Fastening to the supply branch 21 also enables any rotational alignment and positioning that may already be present to a certain extent, to be used for the leakage connection 23. Thus the clamping arms 28, 29 in the installed state engage with a threaded nut constructed on the supply branch 21. This enables a non-positive and positive connection between the leakage connection 23 and the supply branch 21 to be effected. Furthermore, the leakage connection 23 according to the invention can also be deinstalled nondestructively from the supply branch 21, for example to enable repairs etc. to be carried out on the injector 20.

The above description of the exemplary embodiments according to the invention are intended merely to illustrate and not to limit the invention. Various alterations and modifications are possible in the context of the invention, without departing from the scope of the invention or of its equivalents.

What we claim is:

1. A leakage connection for a fuel injector of an internal combustion engine, said connection comprising:

an injector component incorporating an integrated leakage nipple for the attachment of a leakage return line, wherein said connection is a single unitary piece, wherein the injector component is a coupling element between an injector and an engine component.

2. A leakage connection according to claim 1, wherein the coupling element is a centralizer sleeve for centering the injector in a cylinder head of the internal combustion engine, or an attenuation element for attenuating vibrations from the cylinder head on the injector.

3. A leakage connection according to claim 1, wherein an internal wall of the coupling element is constructed as a sealing seat for a ring-shaped sealing.

4. A leakage connection for a fuel injector of an internal combustion engine, said connection comprising:

an injector component incorporating an integrated leakage nipple for the attachment of a leakage return line, wherein said connection is a single unitary piece, wherein the injector component incorporates a first leakage connection and a second leakage connection, wherein the leakage connections of different injectors are connected to a leakage return line arranged in series.

5. A leakage connection for an injector, which injects fuel into a combustion chamber of an internal combustion engine, said leakage connection incorporates an integrated leakage nipple for attachment to a leakage return line and an integrated retaining device to enable the leakage connection to be fastened to another injector component.

6. A leakage connection according to claim 5, wherein the retaining device incorporates two clamping arms for a non-positive and positive connection with the injector component.

7. A leakage connection according to claim 6, wherein the clamping arms incorporate a fixing area and an installation assistance area.

8. A leakage connection according to claim 6, wherein the clamping arms are arranged laterally on a leakage drain of the leakage connection, whereby the connection point between the clamping arms and the leakage drain is also configured as a swivel point for the clamping arms.

9. A leakage connection according to claim 5, wherein the leakage connection is constructed in a T-shape with two integrated leakage nipples.

10. A leakage connection according to claim 5, wherein the injector component to which the leakage connection can be fastened is a fuel supply branch.

11. A leakage connection according to claim 10, wherein the fixing areas are constructed in flattened form, perpendicular to the axial direction of the fuel supply branch.

12. A leakage connection according to claim 1, wherein the integrated leakage nipple comprises a leakage bore which connects to a leakage inflow bore running approximately horizontal in the injector component, wherein the leakage bore is positioned at the leakage inflow bore at an angle of approximately 45° to a principle axis of the fuel injector when the connection is assembled to the fuel injector, wherein a vertically running leakage collection bore is configured in the injector.

13. A leakage connection according to claim 1, wherein the injector component incorporates a first leakage connection and a second leakage connection.

14. A leakage connection according to claim 1, wherein a recess is constructed in the injector at a connecting point between a leakage bore in the leakage connection and a leakage inflow bore in the injector.

15. A leakage connection according to claim 14, wherein the recess is constructed as a completely circumferential groove in the injector.

16. A leakage connection according to claim 14, wherein the connecting point between the leakage line in the leakage connection and the leakage inflow bore in the injector is sealed by means of at least one sealing ring.

17. A leakage connection according to claim 16, wherein the sealing ring is arranged in the injector or in the injector component with an integrated leakage connection.

18. A leakage connection according to claim 1, wherein the injector component is manufactured from plastic.

19. A leakage return device for returning a fuel leakage from a fuel injector, the leakage return device comprising:

a leakage connection for a fuel injector of an internal combustion engine, said connection comprising:

an injector component incorporating an integrated leakage nipple for the attachment of a leakage return line, wherein said connection is a single unitary piece, wherein the injector component is a coupling element between an injector and an engine component.

* * * * *